US008251585B2

(12) United States Patent
Moulin

(10) Patent No.: US 8,251,585 B2
(45) Date of Patent: Aug. 28, 2012

(54) METHOD TO MANUFACTURE FASTENING ASSEMBLIES COMPRISING LUMENS, METHOD TO FORM BAGS, CORRESPONDING STRIP OF ASSEMBLIES, AND CORRESPONDING BAGS

(75) Inventor: Isabelle Moulin, Paris (FR)

(73) Assignee: S2F Flexico, Henonville (FR)

( * ) Notice: Subject to any disclaimer, the term of this patent is extended or adjusted under 35 U.S.C. 154(b) by 474 days.

(21) Appl. No.: 12/618,469

(22) Filed: Nov. 13, 2009

(65) Prior Publication Data

US 2010/0124385 A1 May 20, 2010

(30) Foreign Application Priority Data

Nov. 17, 2008 (FR) ..... 08 57797

(51) Int. Cl.

| | |
|---|---|
| ***B65D 33/14*** | (2006.01) |
| ***B65D 33/00*** | (2006.01) |
| ***B65D 65/26*** | (2006.01) |
| ***B65D 33/16*** | (2006.01) |
| ***B65B 61/18*** | (2006.01) |

(52) U.S. Cl. ..... 383/5; 383/203; 383/204; 383/207; 383/63; 383/64; 383/61.2; 383/61.3; 53/412

(58) Field of Classification Search ..... 383/5, 61.2, 383/61.3, 63, 64, 203, 204, 207; 24/30.5 R, 24/399, 400; 53/139.2, 412
See application file for complete search history.

(56) References Cited

U.S. PATENT DOCUMENTS

| | | | |
|---|---|---|---|
| 2003/0050167 | A1 | 3/2003 | Kinigakis et al. |
| 2003/0208989 | A1 | 11/2003 | Thomas et al. |
| 2004/0050017 | A1 | 3/2004 | Thomas et al. |

FOREIGN PATENT DOCUMENTS

| | | |
|---|---|---|
| EP | 1418133 | 5/2004 |
| WO | WO02/13649 | 2/2002 |

*Primary Examiner* — Nathan J Newhouse
*Assistant Examiner* — Nina Attel
(74) *Attorney, Agent, or Firm* — Alston & Bird LLP

(57) ABSTRACT

The invention concerns a method to manufacture fastening assemblies (1) for bags, characterized in that, for each assembly (1), it comprises the steps of supplying interlocking profiles (11) provided with flanges (12) for attachment to a bag; mounting an actuating slider (13) on the profiles (11); forming two end stops (2) for the slider (13) in the profiles (11); forming two lumens (3) in the attachment flanges (12); each lumen (3) having a longitudinal extension (E/2); forming two lines of weakness (4) between each lumen (3) and an upper part (111) of the profiles (11). The invention also concerns a corresponding bag-forming method, a corresponding strip of assemblies, and corresponding bag.

10 Claims, 5 Drawing Sheets

METHOD TO MANUFACTURE FASTENING ASSEMBLIES COMPRISING LUMENS, METHOD TO FORM BAGS, CORRESPONDING STRIP OF ASSEMBLIES, AND CORRESPONDING BAGS

GENERAL TECHNICAL AREA

The present invention concerns the area of packaging bags.

PRIOR ART

Numerous packaging bags and numerous systems and methods for their formation have already been proposed.

In particular, bags are known having a film which forms walls, on which an assembly is affixed comprising interlocking profiles for closing and opening. The profiles are advantageously provided with flanges for joining of the assembly onto the walls of each bag, and with a slider to actuate the profiles for their opening and closing.

It is desirable that access to the actuating slider, by an end-user of the bag, should be very easy.

From U.S. Pat. No. 6,470,551, and as shown FIG. 1, a bag 10 is known whose access to the actuating slider 13 of the profiles 11 is facilitated despite the presence of an opening tamper evident header 71 on the bag 10.

As shown FIG. 1, after opening the tamper evident header 71, the slider 13 is easy to access since it is positioned above one upper end 73' of the bag 10, whilst being blocked by end stops 2 on the profiles 11.

The known method to form the bag in FIG. 1 has disadvantages however, in particular on account of the method used to manufacture the assemblies 1, as shown FIG. 2.

The known method to manufacture the assemblies 1, for each assembly 1, comprises in particular the main steps of:

- providing interlocking profiles 11 having flanges 12 for joining onto the bag,
- forming notches 30 in the profiles 11,
- mounting an actuating slider 13 on the profiles 11, via the notches 30;
- forming end stops 2 for the slider 13 in the profiles 11.

The forming of notches 30 in the profiles 11 makes the strip 100 grouping the assemblies together 1 considerably more flexible, since it is at the profiles 11 where most of the constituent material of the assembly lies, the flanges 12 only being of very narrow thickness.

Therefore, according to the known method, a prior step needs to be added to form preseals 31 to rigidify the strip, to compensate for the loss of profiles 11.

This prior step is difficult and costly.

PRESENTATION OF THE INVENTION

The invention sets out to overcome at least one of these shortcomings.

For this purpose, and according to the invention, a method is proposed to manufacture bag fastening assemblies, characterized in that, for each assembly, it comprises the steps of:

- supplying interlocking profiles provided with flanges for joining onto a bag,
- mounting an actuating slider on the profiles;
- forming two end stops for the slider in the profiles;
- forming two lumens in the attachment flanges; each lumen having a longitudinal extension;
- forming two lines of weakness between each lumen and an upper part of the profiles.

The invention is advantageously completed by the following characteristics, taken either alone or in any technically possible combination:

- the two end stops are separated by a maximum opening length D1 of the bag;
- the two lumens are separated by a distance D2 corresponding to a bag width; and
- each line of weakness is located at one end of a lumen, so that it does not form a weakness in the profile between an end stop and the slider.

The invention also concerns a corresponding method to form a bag, a corresponding strip of assemblies and corresponding bag.

The invention has numerous advantages.

The invention avoids the forming of notches in the profiles.

Only lumens, formed in the attachment flanges, are provided.

Therefore the strip grouping together the assemblies is not made flexible and maintains its rigidity, which largely facilitates its handling when forming the bags, and the reliability of the bag-forming method.

Additionally, there is no longer any need for a prior step to form preseals, in order to rigidify the strip.

The method is therefore simpler to carry out and less costly.

The formed bag nevertheless maintains the same advantages, namely that after the first opening, when the tamper evident header has been removed from the bag, the slider is easy to access since it is positioned above an upper end of the bag whilst being blocked by the end stops on the profiles.

PRESENTATION OF THE FIGURES

Other characteristics, purposes and advantages of the invention will become apparent from the following description, which is a non-limiting illustration and is to be read with reference to the drawings in which:

FIG. 1, already described, schematically illustrates a prior art bag;

FIG. 2, already described, schematically illustrates a known method to fabricate the assemblies;

In all the figures, similar parts carry identical reference numbers.

DETAILED DESCRIPTION

As indicated previously, the present invention concerns the manufacture on an automated machine of fastening assemblies for reclosable bags, and the forming on an automated machine of the corresponding reclosable bags.

The present invention can be applied both to automated bag-forming machines with horizontal travel and to automated bag-forming machines with vertical travel.

Additionally, the following description does not in any way assume the position of the machine: the joining of the fastening assembly can be made longitudinally or transversely to the direction of travel of the packaging film.

Also, the present invention applies both to automated bag-forming machines with bag filling during bag formation, and to machines which fill the bags after the forming step.

The forming of bags according to the invention may optionally be geographically separated from the place of manufacture of the assemblies according to the invention, or at a single site and/or during successive steps.

Figure 1:
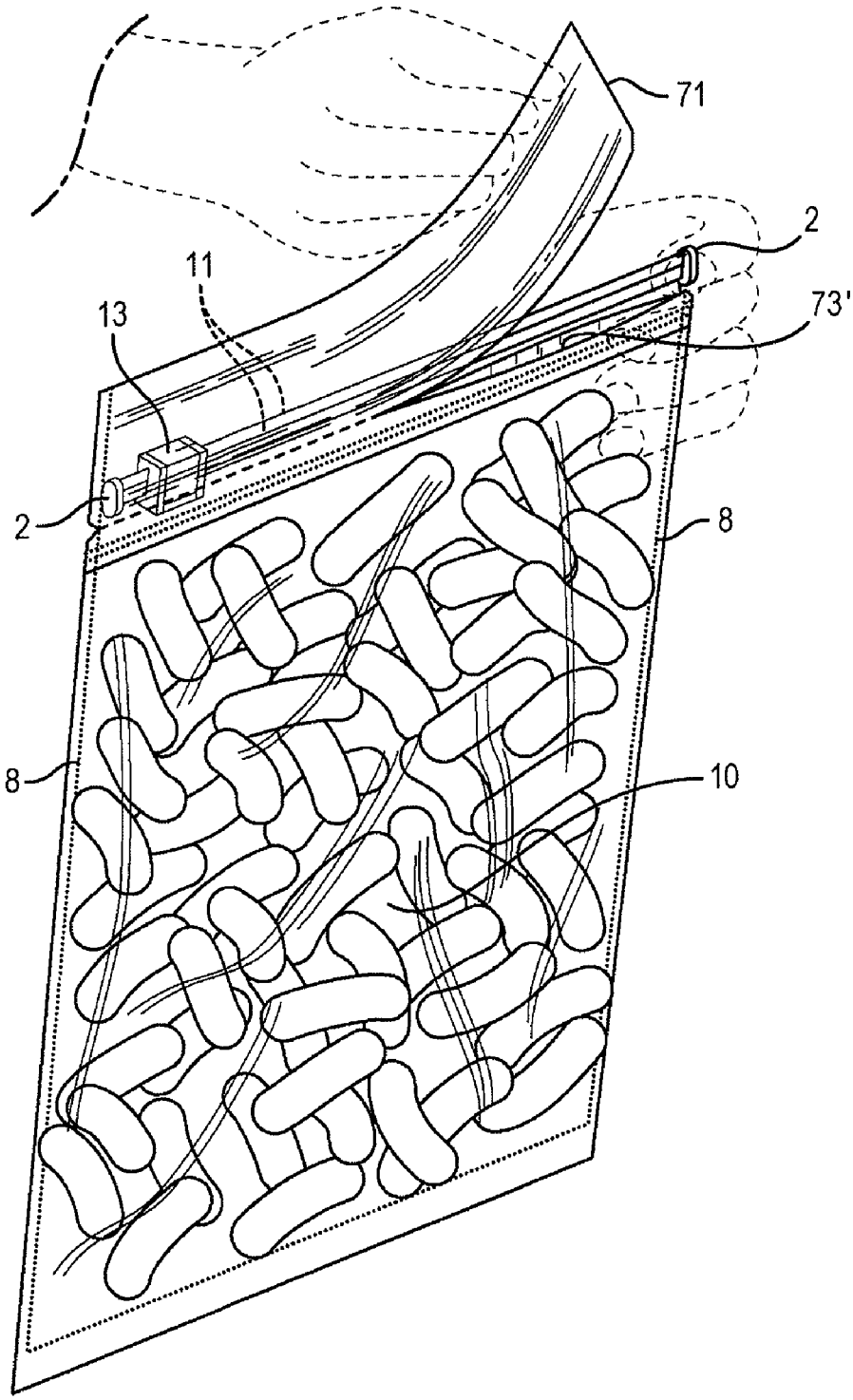
Figure 2:
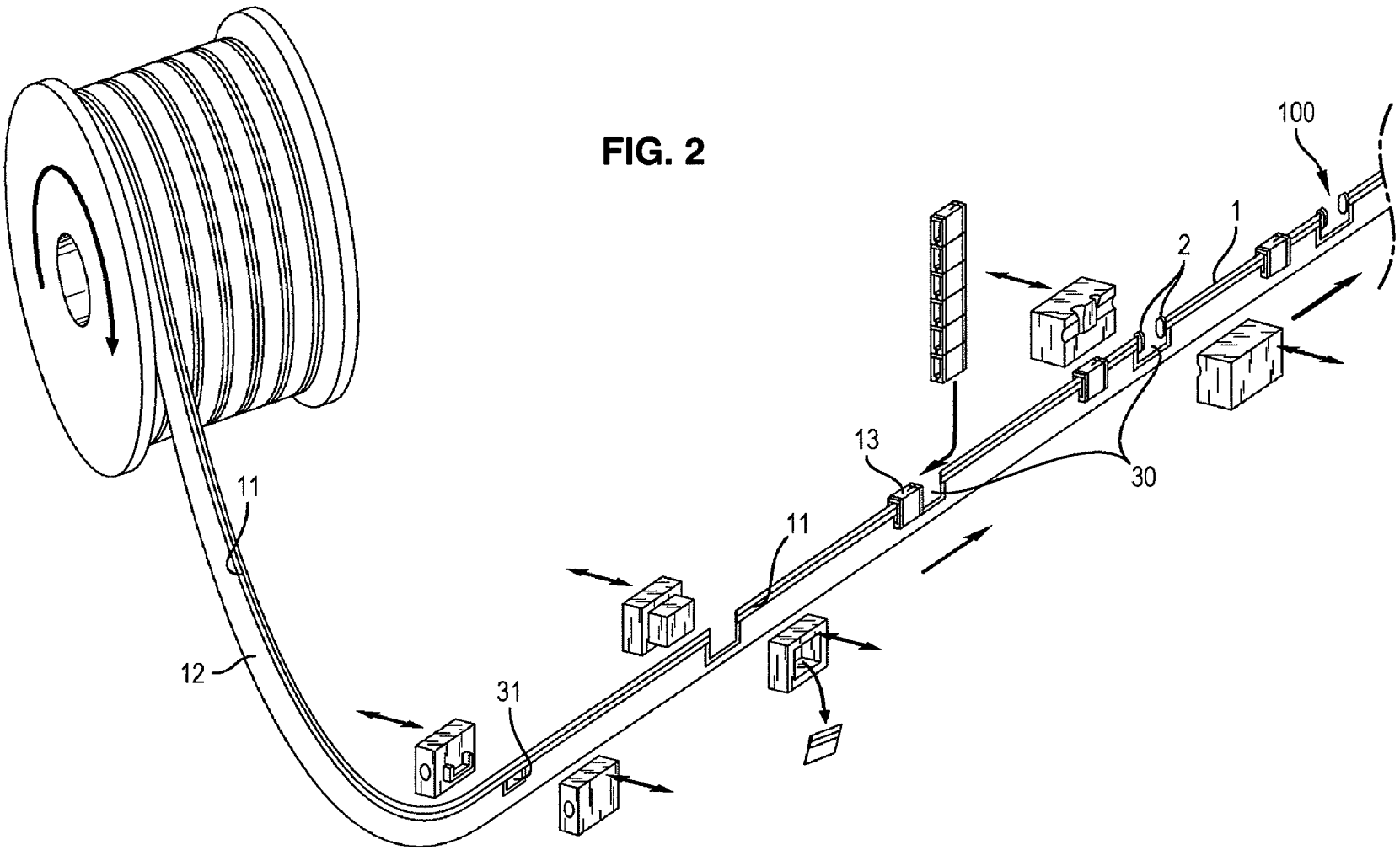
Figure 3:
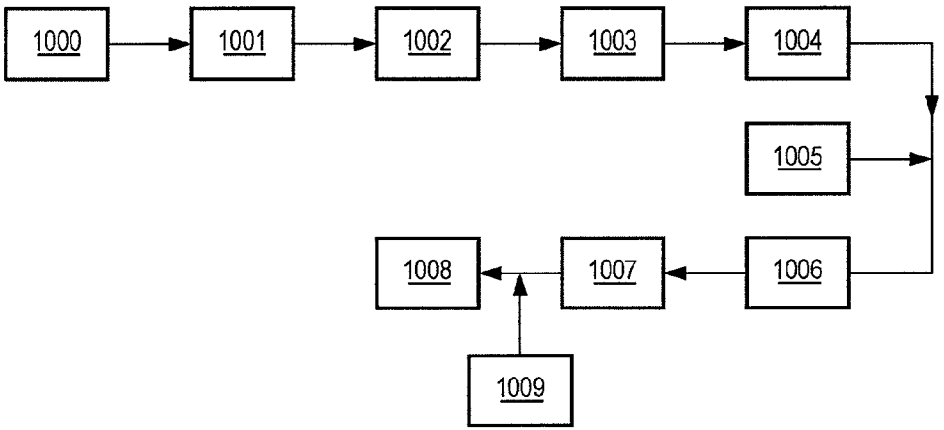
FIG. 3 is a schematic depicting the main steps of a method to manufacture a strip of assemblies according to the invention, and the main steps of a method to form a bag according to the invention.
Figure 4:
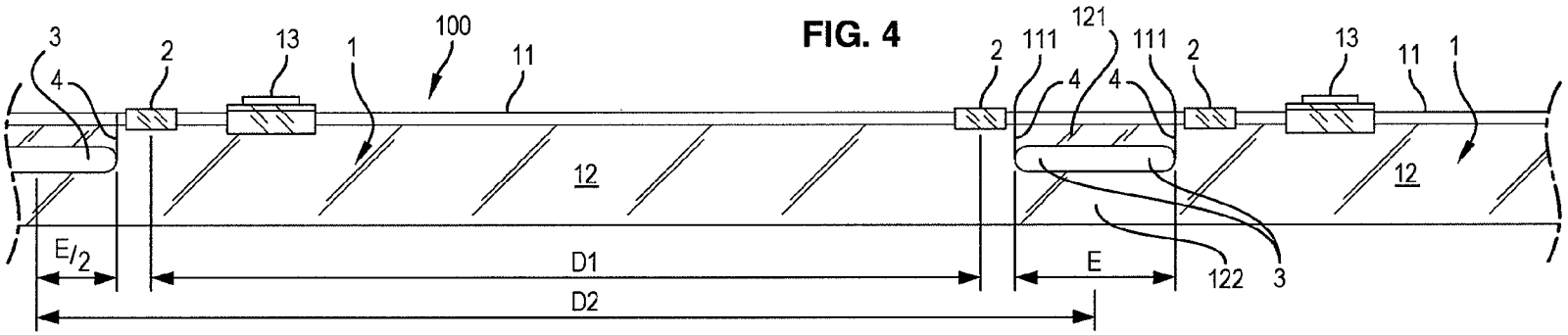
FIG. 4 shows a strip grouping together the assemblies of the invention.
Figure 7:
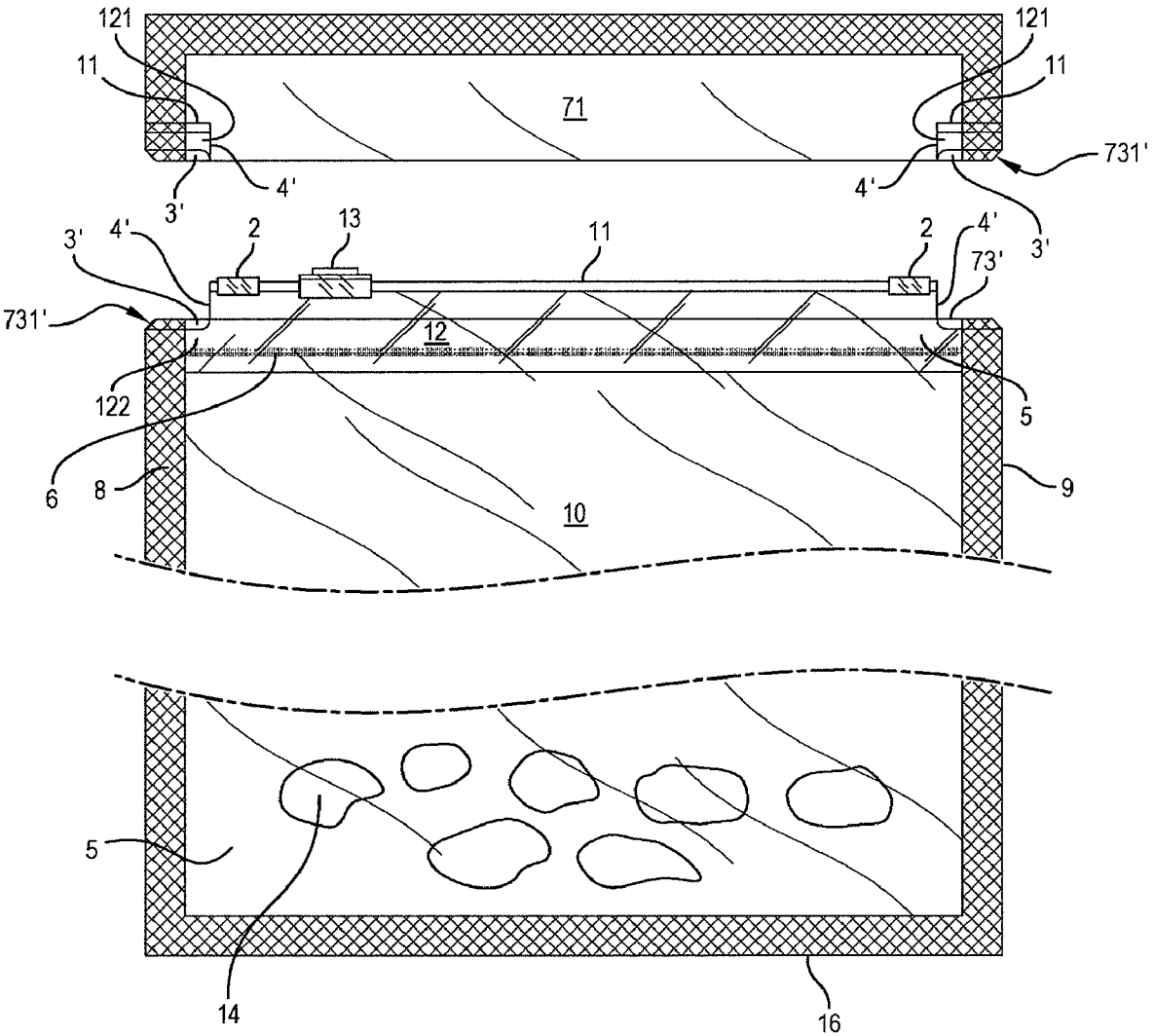
FIG. 7 illustrates a bag according to the invention after the removal of its opening tamper evident header.

FIG. 3, also with reference to FIGS. 4 and 7, schematically illustrates the main successive steps of one possible method to manufacture fastening assemblies 1 for bags 10.

According to the method, for each assembly 1, there is a step 1000 to supply interlocking profiles 11, provided with flanges 12 for joining onto the bag 10.

The flanges 12 conventionally extend from the profiles 11 over a certain width to allow easy attachment of the assembly 1 onto the walls 5 of the bag 10.

The supply 1000 of profiles 11 is conventionally made by conveying, e.g. unreeling from a spool, and is not described in further detail in the remainder of the present description.

The interlocking profiles 11 are known and are not described in detail hereunder. They are of male/female interlocking type for example, or any other equivalent means.

The assembly 1 is in thermoplastic material as is conventional.

The following step is the mounting step 1001 of an actuating slider 13 on the profiles 11.

Again, as is conventional, the slider 13 comprises a base plate with two sidewalls and a central rib. The sidewalls and rib cooperate to form two non-parallel corridors which, depending on the direction of movement of the slider, define converging or diverging corridors. They therefore allow opening or closing of the profiles 11. The slider 13 may be in metal or plastic for example.

The mounting of the slider 13 on the profiles 11 can be made by drawing apart the sidewalls of the slider 13 for example, while it is mounted on the profiles 11.

Next is the forming step 1002 of two end stops 2 for the slider 13 in the profiles 11.

The end stops 2 are used to stop the travel of the slider 13 over the profiles 11, between an open position and a closed position of the bag 10. The end stops 2 therefore prevent the slider 13 from coming off the profiles 11, in particular after the first opening of the bag 10, as will be seen below.

The end stops 2 can be formed by any means, for example by welding of the profiles 11, adding clips, but they are preferably formed by ultrasound pre-clamping.

Advantageously, the two end stops 2 are separated by a length D1 which is the maximum opening length of the bag.

The method also comprises a step 1003 to form two lumens 3 in the attachment flanges 12.

As can be seen FIG. 4, each lumen 3 has a longitudinal extension E/2 and forms an orifice passing through the flange 12.

In each flange 12, either side of the extension E corresponding to two contiguous lumens 3 (see FIG. 6), an upper region 121 and a lower region 122 are thereby defined.

Region 121 is joined to the profiles 11, and region 122 defines a lower part joined to the remainder of each flange 12.

Each lumen 3 can be formed by any means, for example by punching the flanges during a halt in their travel movement.

Two successive lumens 3 on each flange 12 of the assembly 1 are separated by a distance D2 corresponding to a width of the bag 10. The lumens of each respective flange 12 are positioned facing each other.

In practice (as can be seen FIG. 6 described in more detail below) it will be appreciated that advantageously a large lumen of extension E (corresponding to two contiguous lumens 3) is formed during each halt in the travel movement of the assembly 1, by punching for example. The large lumen thus formed is then divided into two lumens 3 by a cut 9. The two lumens 3 will therefore come to lie in two consecutive bags after the cut 9.

Also advantageously, the two end stops 2 positioned around a large lumen (see FIG. 6 also) are formed during the same halt in the travel movement of the assembly 1 as for the forming of the large lumen. The two end stops 2 thus formed will therefore come to be positioned in two consecutive bags after the cut 9.

If the description of the method is resumed with reference to FIG. 3, the following step is a step 1004 to form two score lines 4, for each assembly 1, between each lumen 3 and an upper part 111 of the profiles 11.

Each score line 4 therefore forms a line of weakness firstly at the flanges 12, in region 121, and secondly in the profiles 11.

The score lines 4, e.g. perforations, may be mechanically formed by a punch or by laser cutting for example.

Each score line 4 is located at one end of a lumen 3, so that it does not score the profile 11 between an end stop 2 and the slider 13 of each assembly. If this were the case, the end stop 2 would no longer fullfil its role, as will be explained in the remainder of the present description.

In FIG. 4, the score line 4 extends vertically relative to the assembly 1. It can be seen FIG. 6 that the score line 4 can also extend at an angle θ relative to the vertical on the assembly 1, to facilitate tearing along the score line 4 as will be seen below.

On completion of the method to manufacture the assemblies 1 according to the invention, a strip 100 of assemblies 1 is obtained as illustrated FIG. 4.

The forming of a bag 10 will now be described, by means of the strip 100 in particular.

Figure 6:
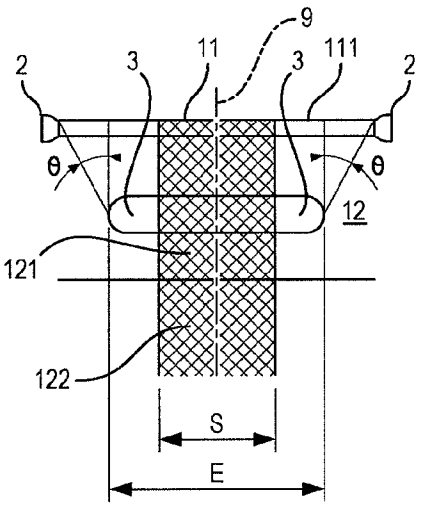
FIG. 6 shows a detail of FIG. 5.
Figure 5:
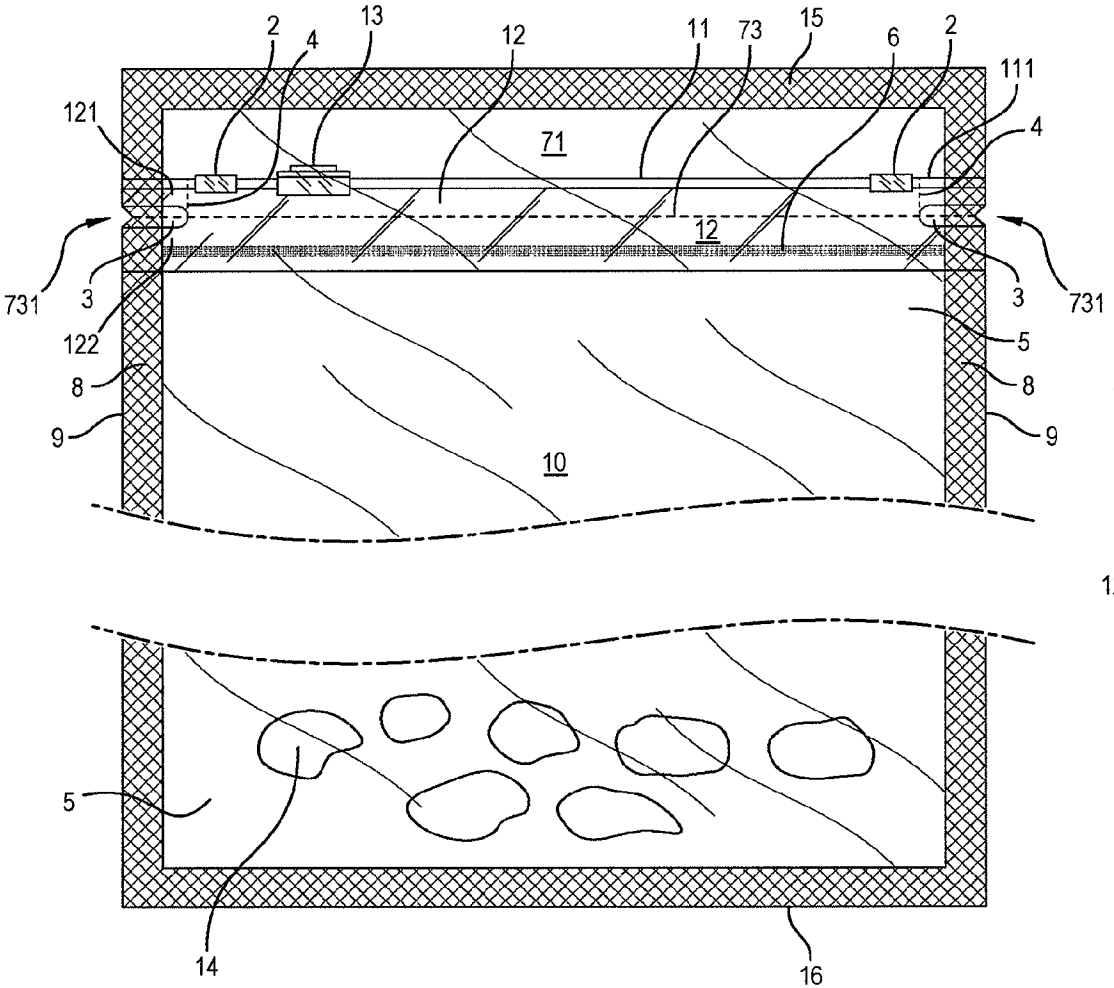
FIG. 5 shows a bag according to the invention, provided with its tamper evident header.

Therefore, according to the invention and again with reference to FIG. 3 but also to FIGS. 5 and 6, a method is proposed to form at least one reclosable bag 10.

For each bag 10, the method comprises a step 1005 to provide a packaging film 7 able to form walls 5 of the bag 10.

The providing 1005 of the film 7 is conventionally made by continuous conveying, unreeling from a spool for example, and is not described in further detail in the remainder of the present description.

The packaging film 7 can be formed of any material, such as a plastic material for example, or material of paper or cardboard type. The film 7 may also be in a composite and/or metalized material.

The method then comprises a step 1006 to join the assemblies 1 obtained with the method of the invention, it being recalled that the strip 100 grouping together these assemblies 1 can be seen FIG. 4.

The joining 1006 of the assemblies 1 to the film 7 is made, as is conventional, via the attachment flanges 12, for example using joining 6 of heat-welding or bonding type.

The method then comprises a step 1007 to form a side weld 8 at each lumen 3, for example using sealing bars known to the person skilled in the art.

FIG. 6 shows that each weld 8 has a width S/2 smaller than the extension E/2 of each lumen 3. If this were not the case, the functioning of the bag would be deteriorated as will be understood in the remainder of the present description. It will be appreciated, as previously, that in practice a large weld of extension S (corresponding to two contiguous welds 8) is advantageously formed during each temporary stoppage in the travel movement of the assembly 1. The large weld thus formed is then divided into two welds 8 by a cut 9. The two welds 8 will therefore come to be positioned in two consecutive bags after the cut 9.

The method also comprises a step 1008 to separate into individual bags 10 by a cut 9 at each side weld 8.

The cut 9 is made, as is conventional, using cutting means on the forming machine, and is not described in further detail in the remainder of the present description.

Preferably, the method is conducted so that the joining step 1006 of the assemblies 1 onto the film 7 is made at an intermediate height i.e. not fully in the upper part of the mouth of the bag 10.

Therefore, part of the film 7 is able to form an opening tamper evident header 71 covering the slider 13, for example by folding or welding 15 (see FIG. 5) the walls 5 of the bag 10.

Preferably, in this case, the method further comprises a step 1009 to form a line of weakness 73 in the film 7.

The line of weakness 73 is positioned on a side opposite the tamper evident header 71, relative to the profiles 11.

The line of weakness 73 may consist of perforations formed in the film 7, or of a thinner film thickness. Preferably, the line 73 is scored by laser.

At the cut 9 and the line of weakness 73, at least one incision 731 can be made, for example on each side of the bag 10, so that tearing of the wall 5 of the bag 10 at this point is further facilitated.

The bag 1 is filled with any content 14 e.g. a food product of grated cheese type.

It is recalled that the bag 10 can be filled when the bag 10 is being formed, when the film 7 is traveling on the bag forming machines. It can also be filled subsequently, on the bag-forming site or at another site.

Filling can be conducted via one side of the bag, perpendicular to the assembly 1. The side, through which the content 14 was added to the bag 10, is welded by a weld 8 to obtain a fully sealed bag on all its sides. Filling can also be made via the side opposite the mouth of the bag 10. In this case an adequate fold is made to impart an ideal capacity relative to the volume content 14 of the bag. It is also possible to form a gusset on the side opposite the mouth of the bag. Finally, it is also possible to weld this side of the bag 10 with a weld 16 (see FIG. 5).

After the method in FIG. 3, a bag 10 is obtained according to FIG. 5.

It is specified here that the order of the steps with respect to each other is not a strict order: some steps can take place in an order other than the order described above (for example the forming of the lumens may take place before the forming of the end stops), or they can be conducted simultaneously (for example separating into individual bags and side welding).

The principle behind the functioning of the bag 10 is the following, as shown FIG. 7.

When the bag 10 is first opened, the user takes hold of the tamper evident header 71 at a weld point 8, and tears the wall 5 of the bag along the line of weakness 73. Tearing of the wall 5 is facilitated firstly by the line of weakness 73 and secondly by the incision 731.

Region 122 of the flange 12 remains joined to the bag on account of the weld 8 of width S.

On the other hand, the upper region 121 of the flange 12 (also connected to the profiles 11) is joined to the tamper evident header 71, on account of the weld 8 of width S. It separates from the bag at the same time as the tamper evident header 71 due to tearing of the lines of weakness 4, as far as the upper part 111 of the profiles 11.

In FIG. 6, the reference <<'>> is given to parts similar to those in FIG. 5, after the first opening. A distinction is therefore made between the semi-lumens 3', the semi-scores 4', and the semi-incisions 731'.

After removing the tamper evident header 71, it is easy to access the slider 13 since it is positioned above the upper end 73' of the bag 10, whilst being blocked by the end stops 2 on the profiles 11.

The invention claimed is:

1. A method to manufacture fastening assemblies (1) for bags (10), characterized in that, for each assembly (1), it comprises the steps of:

supplying (1000) interlocking profiles (11) provided with flanges (12) for attaching to a bag (10), mounting (1001) an actuating slider (13) on the profiles (11);

forming (1002) two end stops (2) to stop the slider (13) on the profiles (11);

forming (1003) two lumens (3) in the attachment flanges (12); each lumen (3) having a longitudinal extension (E/2), forming (1004) two lines of weakness (4) between each lumen (3) and an upper part (111) of the profiles (11).

2. The method according to claim 1, wherein the two end stops (2) are separated by a maximum opening length (D1) of the bag.

3. The method according to claim 1, wherein the two lumens (3) are separated by a distance (D2) corresponding to a width of the bag (10).

4. The method according to claim 1, wherein each line of weakness (4) is located at one end of a lumen (3), so that it does not weaken the profile between an end stop (2) and the slider (13).

5. A method to form at least one bag (10), characterized in that, for each bag (10), it comprises a step of:

providing (1005) a film (7) able to form walls (5) of the bag (10);

joining (1006) the assemblies (1) obtained with the method according to any of claims 1 to 4, namely assemblies (1) each comprising:

interlocking profiles (11) provided with attachment flanges (12), a slider (13) to actuate the profiles, two end stops (2) for the slider (13) in the profiles (11), two lumens (3) in the attachment flanges (12), each lumen (3) having a longitudinal extension (E/2), and two lines of weakness (4) between each lumen (3) and an upper part (111) of the profiles (11), the joining of the assemblies (1) onto the film (7) being made via the attachment flanges (12);

forming (1007) a side weld (8) at each lumen (3), each weld (8) having a width (S/2) smaller than the extension (E/2) of each lumen (3);

separating (1008) into individual bags (10) by a cut (9) at each side weld (8).

6. The method according to claim 5, wherein the joining step of the assemblies (1) onto the film (7) is made at an intermediate height, so that part of the film (7) forms an opening tamper evident header (71) covering the slider (13).

7. The method according to claim 6, further comprising a step (1009) to form a line of weakness (73) in the film (7), the line of weakness (73) lying on a side opposite the tamper evident header (71) with respect to the profiles (11).

8. A strip (100) of assemblies (1), characterized in that each assembly (1) comprises:

interlocking profiles (11) provided with attachment flanges (12), a slider (13) to actuate the profiles, two end stops (2) to stop the slider (13) in the profiles (11), two lumens (3) in the attachment flanges (12), each lumen (3) having a longitudinal extension (E/2), and two lines of weakness (4) between each lumen (3) and an upper part of the profiles (11).

9. A bag (10) comprising a film (7) materializing walls, characterized in that it comprises an assembly comprising:

interlocking profiles (11) provided with attachment flanges (12), a slider (13) to actuate the profiles, two end stops (2) to stop the slider (13) in the profiles (11), two lumens (3) in the attachment flanges (12), each lumen (3) having a longitudinal extension (E/2), and two lines of weakness (4) between each lumen(3) and an upper part of the profiles (11).

10. The bag (10) according to claim 9, further comprising an opening tamper evident header (71) materialized by:

part of the film (7) covering the slider (13), and a line of weakness (73) in the film (7), the line of weakness (73) lying on a side opposite the opening tamper evident header (71) with respect to the profiles (11).

* * * * *